US006251849B1

(12) United States Patent
Jeschke et al.

(10) Patent No.: US 6,251,849 B1
(45) Date of Patent: Jun. 26, 2001

(54) CLEANING AGENT FOR HARD SURFACES BASED ON CATIONIC POLYMER SOIL-RELEASE COMPOUNDS

(75) Inventors: Rainer Jeschke, Duesseldorf; Ludwig Schieferstein, Ratingen; Katica Bocarac, Duesseldorf; Paul Birnbrich, Solingen; Herbert Fischer, Duesseldorf; Rainer Kade, Solingen; Eva Kiewert, Duesseldorf; Dieter Nickel, Erkrath; Horst-Dieter Speckmann, Langenfeld; Juan-Carlos Wuhrmann, Duesseldorf, all of (DE)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 09/091,041

(22) PCT Filed: Nov. 28, 1996

(86) PCT No.: PCT/EP96/05266

§ 371 Date: Dec. 18, 1998

§ 102(e) Date: Dec. 18, 1998

(87) PCT Pub. No.: WO97/20908

PCT Pub. Date: Jun. 12, 1997

(30) Foreign Application Priority Data

Dec. 7, 1995 (DE) ..... 195 45 630

(51) Int. Cl.[7] ..... C11D 3/22

(52) U.S. Cl. ..... 510/470; 510/475; 510/504; 510/509; 510/528; 510/299; 510/506

(58) Field of Search ..... 510/470, 506, 510/395–397, 421–424, 299, 400, 475, 504, 528, 509

(56) References Cited

U.S. PATENT DOCUMENTS

| | | | | |
|---|---|---|---|---|
| 4,152,307 | * | 5/1979 | Shibahara et al. | 524/318 |
| 4,454,060 | | 6/1984 | Lai et al. | 252/547 |
| 4,534,892 | * | 8/1985 | Suzuki et al. | 510/416 |
| 5,374,716 | | 12/1994 | Biermann et al. | 536/18.6 |
| 5,433,863 | * | 7/1995 | Braden et al. | 210/708 |
| 5,576,425 | | 11/1996 | Hill et al. | 536/18.6 |
| 5,686,024 | * | 11/1997 | Dahanayake et al. | 516/14 |
| 5,698,509 | * | 12/1997 | Nedonchelle | 510/424 |
| 5,756,436 | * | 5/1998 | Royce et al. | 510/122 |

FOREIGN PATENT DOCUMENTS

| | | | |
|---|---|---|---|
| 0 299 787 | | 1/1989 | (EP) . |
| 0 301 298 | | 2/1989 | (EP) . |
| 0 467 472 | | 1/1992 | (EP) . |
| 0 494 554 | | 7/1992 | (EP) . |
| 0 522 556 | | 1/1993 | (EP) . |
| 0 570 226 | * | 11/1993 | (EP) . |
| 2 006 811 | | 5/1979 | (GB) . |
| 2 104 091 | | 3/1983 | (GB) . |
| WO90/03977 | | 4/1990 | (WO) . |

OTHER PUBLICATIONS

Klaften, et al., Patent Terminological Dictionary at p. 85 (4th ed. 1971).
Seifen–Ole–fette–Wachse, 112: 371–72 (1986).
Derwent Patent Abstract (WPAT) 92–235633/29, for EP 494554, 7.92.
Derwent Patent Abstract (WPAT) 89–032811/05, for EP 301826, 1.89.
Derwent Patent Abstract (WPAT) 90–109072/15, for WO 9003977, 4.90.

* cited by examiner

*Primary Examiner*—Bruce H. Hess
*Assistant Examiner*—Dawn L. Garrett
(74) *Attorney, Agent, or Firm*—Wayne C. Jaeschke; Glenn E. J. Murphy

(57) ABSTRACT

Cationic polymers comprising at least 40 mole percent monomer units of the formula (I):

(I)

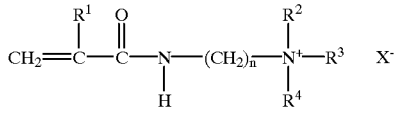

wherein n is 2 to 4, $R^1$ is hydrogen or methyl, and $R^2$, $R^3$ and $R^4$ independently are hydrogen, $C_{1-4}$ alkyl or $C_{1-4}$ alkenyl, and $X^-$ is an anion selected from the group consisting of halide anions and monoalkyl anions of sulfuric acid semiester are used as soil-release compounds in hard surface cleaners.

35 Claims, No Drawings

CLEANING AGENT FOR HARD SURFACES BASED ON CATIONIC POLYMER SOIL-RELEASE COMPOUNDS

BACKGROUND OF THE INVENTION

This invention relates to the use of cationic polymers as soil release compounds in cleaners for hard surfaces. The invention also relates to cleaners for hard surfaces which contain these cationic polymers as soil release compounds.

Hard surfaces occurring in the home and in the institutional sector are cleaned with various cleaners which differ from one another both in the concentration of their cleaning-active ingredients, in the form in which they are packaged, for example concentrates, spray cleaners, gels and powders, and in their pH value, for example acidic, neutral and alkaline cleaners. The cleaners are essentially aqueous solutions of surfactants which may contain builders, water-soluble solvents, solubilizers, water-soluble abrasives, etc. as additives. To be able to meet consumer requirements, cleaners of the type in question are required to be effective against all the various soils encountered.

In addition, it would be desirable if the cleaners contained components of the type which facilitate the removal of soil in the second and subsequent applications of the cleaners. Such components are known as soil release compounds. Most soil release compounds are polymeric compounds. These polymers in influence the surface of the articles to be cleaned by positively influencing the removal of soil in the second and all other cleaning cycles. Their mode of action is characterized in that they have a certain tendency in the first cleaning cycle to be deposited onto the cleaned surfaces (substantivity), thus modifying their surface properties. The polymers do not form permanent films, but instead can be removed again, in some cases very easily, with aqueous solutions, for example in the next cleaning cycle. A combination of a marked tendency to wet hard surfaces by a soil release polymer with high stability against removal (in conjunction with soil stabilization in the wash liquor) without reducing the cleaning performance of cleaners would have to be regarded as favorable from the point of view of the consumer.

European patent application EP-A 0 467 472 describes a cleaner for hard surfaces which contains water-soluble anionic, cationic or nonionic polymers as soil release compounds. Polymers containing quaternized ammonium alkyl methacrylate groups in the molecule are mentioned in particular as examples of such polymers. The cleaners described in this document only develop their soil-repelling effect after having already been applied once to the hard surface.

The problem addressed by the present invention was to provide compounds which would act as soil release compounds when used in aqueous surfactant solutions for the manual cleaning of hard surfaces, which would positively influence or at least would not reduce the removal of soil and stabilization of the soil removed in the cleaning liquor during the first application and which would show high surface substantivity towards aqueous solutions, thereby improving the cleaning performance of the cleaner in the event of repeated application.

DESCRIPTION OF THE INVENTION

The present invention relates to the use of cationic polymers containing monomer units corresponding to formula I:

(I)

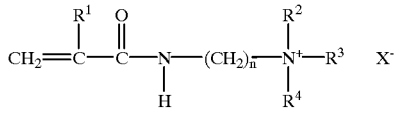

in which n is a number of 2 to 4, preferably 3, $R^1$ is hydrogen or a methyl group and $R^2$, $R^3$ and $R^4$ may be the same or different and represent hydrogen or a $C_{1-4}$ alk(en)yl group, $X^-$ is an anion from the group of halide anions or a monoalkyl anion of sulfuric acid semiester, as soil release compounds in cleaners for hard surfaces.

It has been found that the cationic polymers according to the invention act as soil release compounds in cleaners for hard surfaces. In the manual cleaning of hard surfaces in particular, soil removal and stabilization of the soil removed in the cleaning liquor are both positively influenced and improved surface substantivity is achieved.

The polymers contain the monomer units corresponding to formula I in a quantity of, preferably, 40 mole-% to 100 mole-% and, more preferably, more than 50 mole-%. The polymers thus develop a significant soil release effect. Besides the monomer units corresponding to formula I, unsaturated monocarboxylic acids, such as acrylic acid, methacrylic acid, crotonic acid and the like; olefins, such as ethylene, propylene and butene; alkyl esters of unsaturated carboxylic acids, more particularly esters of acrylic acid and methacrylic acid of which the alcohol components contain $C_{1-6}$ alkyl groups, such as methyl acrylate, ethyl acrylate, methyl methacrylate and hydroxy derivatives thereof, such as 2-hydroxyethyl methacrylate, optionally further substituted aromatic compounds containing unsaturated groups, such as styrene, methyl styrene, vinyl styrene; and heterocyclic compounds, such as vinyl pyrrolidone, may be used as comonomers. Preferred comonomers are acrylic acid, methacrylic acid and $C_{1-6}$ esters thereof.

The polymers used in accordance with the invention may be present in the cleaners in a quantity of 0.01 to 10% by weight and preferably in a quantity of 0.05 to 2% by weight, based on the cleaner as a whole.

The present invention also relates to water-based cleaners for hard surfaces containing.

a) from 0.01 to 10% by weight and preferably from 0.05 to 2% by weight of cationic polymers containing monomer units corresponding to formula I:

(I)

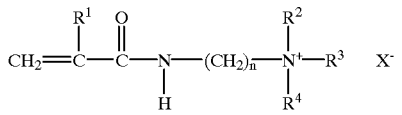

in which n is a number of 2 to 4, preferably 3, $R^1$ is hydrogen or a methyl group and $R^2$, $R^3$ and $R^4$ may be the same or different and represent hydrogen or a $C_{1-4}$ alk(en)yl group, $X^-$ is an anion from the group of halide anions or a monoalkyl anion of sulfuric acid semiester, and b) 0.1 to 50% by weight of one or more nonionic surfactants.

The nonionic surfactants which may be present in the cleaners according to the invention include, for example, alkyl polyglycosides, $C_{8-8}$ alkyl alcohol ethers and nitrogen-containing surfactants.

Alkyl polyglycosides are known nonionic surfactants corresponding to formula II:

$$R^5O—[G]_p \quad (II)$$

in which $R^5$ is an alkyl group containing 8 to 22 carbon atoms, G is a sugar unit containing 5 or 6 carbon atoms, preferably a glucose unit, and p is a number of 1 to 10.

Alkyl polyglycosides (APG) corresponding to formula II may be obtained by the relevant methods of preparative organic chemistry. EP-A1 0 301 298 and WO 90/3977 are cited as representative of the extensive literature available on the subject.

The alkyl polyglycosides may be derived from aldoses or ketoses containing 5 or 6 carbon atoms, preferably from glucose. Accordingly, preferred alkyl polyglycosides are alkyl polyglucosides.

The index p in general formula II indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is mostly a broken number. Alkyl polyglycosides with an average degree of oligomerization p of 1.1 to 3.0 are preferably used. Alkyl polyglycosides with a degree of oligomerization below 1.7 are preferred from the performance point of view.

$C_{8-18}$ alkyl alcohol polypropylene glycol/polyethylene glycol ethers are also known nonionic surfactants which correspond to formula III:

$$R^6O—(CH_2\overset{\overset{\displaystyle CH_3}{|}}{C}HO)_c(CH_2CH_2O)_d—H \quad (III)$$

in which $R^6$ is a linear or branched aliphatic alkyl and/or alkenyl group containing 8 to 18 carbon atoms, c is 0 or a number of 1 to 3 and d is a number of 1 to 20.

$C_{8-18}$ alkyl alcohol polypropylene/polyethylene glycol ethers corresponding to formula III may be obtained by addition of propylene oxide and/or ethylene oxide to alkyl alcohols, preferably to fatty alcohols. Typical examples are polyglycol ethers corresponding to formula III, in which $R^6$ is an alkyl group containing 8 to 18 carbon atoms, c stands for 0 to 2 and d is a number of 2 to 7.

End-capped $C_{8-18}$ alkyl alcohol polyglycol ethers, i.e. compounds in which the free OH group in formula III is etherified, may also be used. The end-capped $C_{8-18}$ alkyl alcohol polyglycol ethers may be obtained by relevant methods of preparative organic chemistry. $C_{8-18}$ alkyl alcohol polyglycol ethers are preferably reacted with alkyl halides, more particularly with butyl or benzyl chloride, in the presence of bases. Typical examples are mixed ethers corresponding to formula III, in which $R^6$ is a technical fatty alcohol group, preferably a $C_{12/14}$ cocoalkyl group, c stands for 0 and d is a number of 5 to 10, which are end-capped with a butyl group.

Other suitable nonionic surfactants are nitrogen-containing surfactants, for example fatty acid polyhydroxyamides, for example glucamides, and ethoxylates of alkyl amines, vicinal diols and/or carboxylic acid amides containing $C_{10-22}$ and preferably $C_{12-18}$ alkyl groups. The degree of ethoxylation of these compounds is generally between 1 and 20 and preferably between 3 and 10. Ethanolamide derivatives of $C_{8-22}$ and preferably $C_{12-16}$ alkanoic acids are preferred. Particularly suitable compounds include lauric acid, myristic acid and palmitic acid monoethanolamides.

The nonionic nitrogen-containing surfactants may be present in quantities of 0.05 to 10% by weight, preferably 0.1 to 5% by weight, based on the cleaner as a whole. Nonionic nitrogen-containing surfactants and cationic polymers are present in a ratio of preferably 40:1 to 1:10 and more preferably 20:1 to 1:5.

Other surface-active components which may be used as or as a substitute for nonionic surfactants in accordance with the present invention are amphoteric or zwitterionic surfactants, for example betaine surfactants or fatty amine oxides.

In addition, the cleaners according to the invention may contain anionic surfactants as an additional surfactant component. The anionic surfactants may be present in quantities of 0.05 to 10% preferably 0.1 to 10% by weight and preferably in quantities of 0.1 to 7.0% by weight, based on the cleaner as a whole. Anionic surfactants and cationic polymers are present in a ratio of preferably 20:1 to 1:20 and, more preferably, 10:1 to 1:10.

Suitable anionic surfactants are, for example, $C_{8-18}$ alkyl sulfates, $C_{8-18}$ alkyl ether sulfates, $C_{8-18}$ alkane sulfonates, $C_{8-18}$ α-olefin sulfonates, sulfonated $C_{8-18}$ fatty acids, $C_{8-18}$ alkyl benzenesulfonates, sulfosuccinic acid mono- and di-$C_{1-12}$-alkyl esters, $C_{8-18}$ alkyl polyglycol ether carboxylates, $C_{8-18}$ N-acyl taurides, $C_{8-18}$ N-sarcosinates and $C_{8-18}$ alkyl isethionates.

By virtue of their foam-suppressing properties, the cleaners according to the invention may also contain soaps, for example alkali metal or ammonium salts of saturated or unsaturated $C_{6-22}$ fatty acids. The soaps may be used in a quantity of up to 5% by weight and are preferably used in a quantity of 0.1 to 2% by weight.

In addition, the cleaners according to the invention may contain the auxiliaries typically present in liquid cleaners for hard surfaces, for example multipurpose cleaners and manual dishwashing detergents. The auxiliaries in question include builders, for example salts of glutaric acid, succinic acid, adipic acid, tartaric acid, benzenehexacarboxylic acid, gluconic acid, citric acid; solvents such as, for example, ethanol, isopropanol, glycol ether; hydrotropes such as, for example, cumene sulfonate, octyl sulfate, butyl glucoside, butyl glycol; cleaning boosters; viscosity controllers such as, for example, synthetic polymers, such as polysaccharides, polyacrylates; pH regulators such as, for example, citric acid, alkanolamines or NaOH; preservatives; disinfectants; dyes and fragrances and opacifiers or even skin protection agents of the type described in EP-A 522 556. The pH value of the cleaning formulations may be varied over a wide range, although the range from 2.5 to 10.5 is preferred.

In one preferred embodiment, the cleaner according to the invention is formulated as a ready-to-use solution which may be used in particular as a spray cleaner.

In another preferred embodiment, the cleaner according to the invention is formulated as a pourable concentrate which may additionally contain a water-soluble abrasive component. Cleaners of this type contain a water-soluble salt and are suitable in concentrated form as scourers and in diluted form as multipurpose cleaners. In this embodiment, the cleaners according to the invention are suitable both as multipurpose cleaners and as manual dishwashing detergents, more particularly for heavily soiled pots and pans.

Suitable water-soluble abrasive components are, in particular, alkali metal carbonates, preferably sodium bicarbonate, with a mean particle size of about 200 $\mu$m±100 $\mu$m. The abrasive component is present in a quantity of preferably more than 50% by weight and, more preferably, between 50 and 65% by weight, based on the cleaner according to the invention.

To stabilize the abrasive component, the cleaner according to the invention is preferably formulated as a gel. The viscosity and hence the flow properties of the cleaners according to the invention may be positively influenced by an addition of up to 5% by weight and, preferably, between about 0.3 and 3% by weight of polyols corresponding to the formula HO—R—OH, where R is an optionally hydroxyl-substituted alkyl group containing about 2 to 6 carbon atoms and preferably 2 to 4 carbon atoms. The polyols include, for example, ethylene glycol, n- and iso-propylene glycols and glycerol.

Naturally occurring polymers and derivatives thereof, such as xanthan gum, other polysaccharides and/or gelatine, may also be added in quantities of up to 2% by weight and preferably in quantities of about 0.1 to 1.0% by weight.

The cleaners according to the invention are particularly suitable for cleaning hard surfaces such as, for example, enamel, glass, china, PVC and other plastics, linoleum, ceramic tiles, marble and metals. At the commercial level, a distinction is made between manual dishwashing detergents which are generally used for cleaning crockery, glasses, cutlery, pots and pans, etc. and multipurpose cleaners which are generally used for cleaning relatively large surfaces encountered in the home.

The advantages of the present invention are illustrated by the following Examples.

EXAMPLES

Physical Tests

The effect of the polymers on the cleaning process was characterized by various physical methods. The multipurpose cleaner (MPC) identified in Table 1, Example 1, to which quantities of 0.2% by weight of polymer from the group listed below were added, was used as a basis for the tests.

- polymer a: polymethacrylamidopropyl trimethyl ammonium chloride
- polymer b: polymethacrylamidopropyl trimethyl ammonium chloride-so-sodium acrylate-co-ethyl acrylate in a molar ratio of 8:3:6
- polymer c: polymethacrylamidopropyl trimethyl ammonium chloride-co-2-ethylhexyl acrylate in a ratio of 9:1 parts by weight
- polymer d: poly[β-(N-methyl-N,N-diethylammonium)-ethyl methacrylate](EP-A467 472)

Determination of the Dynamic Interfacial Tension $\sigma_G$ for Oil-containing Soil The dynamic interfacial tension $\sigma_G$ was determined for various oils using a Lauda drop/volume tensiometer (TVT1, user's guide) in order to be able to investigate the short-term kinetics in the event of a reduction in interfacial tension. The trend followed by the interfacial tension $\sigma_G$ as a function of time [mN/m] is representatively determined in the following for Mazola, a commercial vegetable oil. The ingredients of the cleaning formulations are shown in Table 1 while the test results for Examples E1 to E5 are shown in Table 2.

TABLE 1

| Ingredient | E1 | E2 | E3 | E4 | E5 |
|---|---|---|---|---|---|
| $C_{8/10}$ alkyl polyglucoside, p = 1.5 | 4.00 | 4.00 | 4.00 | 4.00 | 4.00 |
| $C_{12/14}$ fatty alcohol ether · 6 EO | 1.00 | 1.00 | 1.00 | 1.00 | 1.00 |
| Cocofatty acid | 0.5 | 0.5 | 0.5 | 0.5 | 0.5 |
| $NaHCO_3$ | 3.5 | 3.5 | 3.5 | 3.5 | 3.5 |
| Polymer a | | 0.20 | | | |
| Polymer b | | | 0.20 | | |
| Polymer c | | | | 0.20 | |
| Polymer d | | | | | 0.20 |
| Preservative | 0.20 | 0.20 | 0.20 | 0.20 | 0.20 |
| Water | to 100 | to 100 | to 100 | to 100 | to 100 |

TABLE 2

| Time | Dynamic surface tension $\sigma_G$[mN/m] | | | | |
|---|---|---|---|---|---|
| [secs.] | E1 (comparison) | E2 | E3 | E4 | E5 (comparison) |
| 25 | 7.8 | 4.4 | 4.5 | 7.2 | 7.8 |
| 35 | 7.2 | 4.2 | 4.2 | 6.1 | 7.2 |
| 45 | 6.75 | 3.9 | 3.9 | 5.4 | 6.7 |
| 55 | 6.5 | 3.8 | 3.8 | 4.7 | 6.6 |
| 65 | 6.3 | 3.6 | 3.6 | 4.2 | 6.4 |
| 75 | 6.0 | 3.5 | 3.4 | 4.0 | 6.0 |
| 85 | 5.8 | 3.2 | 3.2 | 3.9 | 5.8 |
| 95 | 5.7 | 2.9 | 3.2 | 3.8 | 5.4 |

It is clear from the results set out in Table 2 that the cleaning formulations containing the cationic polymers used in accordance with the invention show distinctly more favorable soil removal behavior than the polymer-free formulations or even the cleaning formulations containing the polymers known from EP-A 467 472.

Wetting Tests

In order to demonstrate the different soil release effect of the cleaning solutions containing various polymers on surfaces, wetting tests were carried out with aqueous solutions on PVC. The tests were carried out by the Wilhelmy method using a Krüss contact angle and adsorption measuring system (Krüss GmbH, Hamburg). To this end, the substrates were immersed in the respective cleaning solutions, after which the solutions were allowed to drain off and the residual cleaning solution was left to dry on the substrate surface. The wetting tension $\sigma_B$ [mN/m] is then detected on immersion of the substrates in water. To determine the soil release effect, the substrates are compared with substrates where the dried layer of residual cleaning solution was rinsed off one or more times with water and dried again. The results set out in Table 3 represent the results obtained after such an additional rinsing step. The wetting tension $\sigma_B$ [mN/m], as a surface effect, was measured for various immersion depths [mm] and the limit value was extrapolated from these data.

The following cleaning formulations were used:

Cleaner 1 corresponds to Table 1, Example 1 (with no addition of polymer)

Cleaner 2 corresponds to Table 1, Example 3 (with a polymer according to the invention)

Cleaner 3 corresponds to Table 1, Example 5 (polymer according to EP-A 0 467 472)

TABLE 3

| Wetting tension $\sigma_B$ [mN/m] | | | | | |
|---|---|---|---|---|---|
| Cleaner 1 from solution | Cleaner 1 1x water | Cleaner 2 from solution | Cleaner 2 1x water | Cleaner 3 from solution | Cleaner 3 1x water |
| 44 | 17.5 | 43 | 31 | 44 | 18.5 |

The test results show that the hydrophilicizing effect of the dried-on layer on the PVC surface is still clearly discernible, even after rinsing, where a polymer is added. Cleaners containing the polymers known from EP-A 467 472 develop this effect to a far lesser extent which shows that the polymers according to the invention also have a considerably better soil release effect.

Testing of Cleaning Performance

The cleaning performance of the cleaning compositions formulated in accordance with the invention was tested by the method described in "Seifen-Öle-Fette-Wachse", 112, 371 (1986) which gives highly reproducible results. In this test, the cleaner to be tested is applied to an artificially soiled plastic surface. The artificial soil used for the diluted cleaner was a mixture of soot, machine oil, triglyceride of saturated fatty acids and low-boiling aliphatic hydrocarbon. The test surface measuring 26×28 cm was uniformly coated with 2 g of the artificial soil using a surface coater.

A plastic sponge was wetted with 10 ml of the cleaning solution to be tested and mechanically wiped over the test surface which had also been coated with 10 ml of the cleaner to be tested. After 10 wiping movements, the cleaned test surface was held under running water and the loose soil was removed. The cleaning effect, i.e. the whiteness of the so-called plastic surface, was measured with a Dr. Lange "Microcolor" color-difference measuring instrument. The clean, untreated white plastic surface served as the white standard.

The measurement of the cleaned surface corresponded to 100% while the measurement of the soiled surface corresponded to 0%, so that the values read off from the cleaned plastic surfaces could be equated with the percentage cleaning performance (% CP). In the following tests, the % CP values shown are the values determined by this method for the cleaning performance of the cleaners tested. They represent averages from three identical tests.

The results obtained were related to the cleaning result obtained with the MPC formulation used as standard which did not contain the polymers according to the invention.

Measured values, sample×100/measured value, standard=*%CP* relative

Some selected examples of cleaning formulations (E6 to E22) and the results obtained with them are set out in Tables 4 to 7.

TABLE 4

| Ingredient | E6 | E7 | E8 | E9 | E10 |
|---|---|---|---|---|---|
| $C_{8/10}$ alkyl polyglucoside, p = 1.5 | 4.00 | 4.00 | 4.00 | 4.00 | 4.00 |
| $C_{12/14}$ fatty alcohol ether · 6 EO | 1.00 | 1.00 | 1.00 | 1.00 | 1.00 |
| Cocofatty acid | 0.5 | 0.5 | 0.5 | 0.5 | 0.5 |
| $NaHCO_3$ | 3.5 | 3.5 | 3.5 | 3.5 | 3.5 |
| Polymer a | | 0.8 | | | |
| Polymer b | | 0.6 | 0.40 | | |
| Polymer c | | | | 0.40 | |
| Preservative | 0.20 | 0.20 | 0.20 | 0.20 | 0.20 |
| Water | to 100 | to 100 | to 100 | to 100 | to 100 |
| Cleaning performance (%) at concentration 9 ml/l | 100 | 148 | 158 | 139 | 135 |

TABLE 5

Multipurpose cleaner with anionic surfactant in the mildly alkaline range

| Ingredient | E11 | E12 | E13 | E14 |
|---|---|---|---|---|
| Na dodecyl benzenesulfonate | 1.00 | 1.00 | 1.00 | 1.00 |
| $C_{12/14}$ fatty alcohol ether · 6 EO | 3.00 | 3.00 | 3.00 | 3.00 |
| $C_{8/10}$ alkyl polyglucoside, p = 1.5 | 4.00 | 4.00 | 4.00 | 4.00 |
| Cocofatty acid | 0.5 | 0.5 | 0.5 | 0.5 |
| Citric acid | 3.00 | 3.00 | 3.00 | 3.00 |
| NaOH | 1.90 | 1.90 | 1.90 | 1.90 |
| Polymer a | | 1.0 | | |
| Polymer b | | | 1.0 | |
| Polymer c | | | | 1.0 |
| Preservative | 0.20 | 0.20 | 0.20 | 0.20 |
| Water | to 100 | to 100 | to 100 | to 100 |
| Cleaning performance (%) at concentration 9 ml/l | 100 | 156 | 137 | 138 |

TABLE 6

Bath cleaner in the mildly acidic range

| Ingredient | E15 | E16 | E17 | E18 |
|---|---|---|---|---|
| $C_{8/10}$ alkyl polyglucoside, p = 1.5 | 3.85 | 3.85 | 3.85 | 3.85 |
| $C_{12/14}$ fatty alcohol ether · 6 EO | 1.00 | 1.00 | 1.00 | 1.00 |
| Citric acid | 4.80 | 4.80 | 4.80 | 4.80 |
| NaOH | 1.00 | 1.00 | 1.00 | 1.00 |
| Ethanol | 1.00 | 1.00 | 1.00 | 1.00 |
| Polymer a | | 0.30 | | |
| Polymer b | | | 0.30 | |
| Polymer c | | | | 0.30 |
| Preservative | 0.20 | 0.20 | 0.20 | 0.20 |
| Perfume oil | 0.90 | 0.90 | 0.90 | 0.90 |
| Water | to 100 | to 100 | to 100 | to 100 |
| Cleaning performance (%) at concentration 8 ml/l | 100 | 139 | 150 | 145 |

TABLE 7

Multipurpose cleaner with water-soluble abrasive in the mildly alkaline range

| Ingredient | E19 | E20 | E21 | E22 |
|---|---|---|---|---|
| Na—$C_{12-14}$-fatty alcohol sulfate | 5.00 | 5.00 | 5.00 | 5.00 |
| $C_{12/14}$ fatty alcohol ether · 2.5 EO (NRE) | 3.50 | 3.50 | 3.50 | 3.50 |
| $C_{12-14}$ fatty alcohol ether · 4 EO | 0.30 | 0.30 | 0.30 | 0.30 |
| Cocofatty acid | 1.00 | 1.00 | 1.00 | 1.00 |
| Sodium bicarbonate | 50.00 | 50.00 | 50.00 | 50.00 |
| Polymer a | | 0.30 | | |
| Polymer b | | | 0.30 | |
| Polymer c | | | | 0.30 |
| Propylene glycol | 0.50 | 0.50 | 0.50 | 0.50 |
| Preservative | 0.20 | 0.20 | 0.20 | 0.20 |
| Perfume oil | 0.40 | 0.40 | 0.40 | 0.40 |
| Water | to 100 | to 100 | to 100 | to 100 |
| Cleaning performance (%) at concentration 3 ml/l | 100 | 123 | 120 | 122 |

It is clear from the Examples that the cleaning performance of the cleaners according to the invention—used as diluted MPC cleaners and as undiluted spray cleaners—in removing oil-containing soil is higher than that of the cleaner which contains no cationic polymers.

What is claimed is:

1. A method of cleaning a hard surface comprising contacting a hard surface in need of cleaning with a soil-cleansing effective amount of a cationic polymer comprising at least 40 mole percent monomer units of the formula (I):

(I)

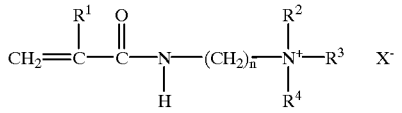

wherein n is 2 to 4, $R^1$ is hydrogen or methyl, and $R^2$, $R^3$ and $R^4$ independently are hydrogen, $C_{1-4}$ alkyl, or $C_{1-4}$ alkenyl, and $X^-$ is an anion selected from the group consisting of halide anions and monoalkyl anions of sulfuric acid semiester.

2. A method according to claim 1, wherein n is 3.

3. A method according to claim 1, wherein the cationic polymer comprises at least 50 mole percent of monomer units of the formula (I).

4. A hard surface cleaner comprising:

a) 0.01% to 10% by weight of a cationic polymer comprising at least 40 mole percent monomer units of the formula (I):

(I)

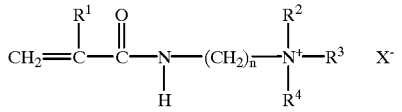

wherein n is 2 to 4, $R^1$ is hydrogen or methyl, and $R^2$, $R^3$ and $R^4$ independently are hydrogen, $C_{1-4}$ alkyl, or $C_{1-4}$ alkenyl, and $X^-$ is an anion selected from the group consisting of halide anions and monoalkyl anions of sulfuric acid semiester; and b) 0.1% to 50% by weight of a nonionic surfactant.

5. A cleaner according to claim 4, wherein the nonionic surfactant comprises:

a) an alkyl polyglycoaide of the formula (II):

$$R^5O—[G]_p \quad \text{(II)}$$

wherein $R^5$ is an alkyl group containing 8 to 22 carbon atoms, G is a sugar unit containing 5 or 6 carbon atoms and p is a number of 1 to 10; or b) a fatty alcohol polypropylene glycol/polyethylene glycol ethers of the formula (III)

(III)

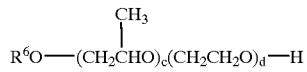

wherein $R^6$ is a linear or branched aliphatic alkyl or alkenyl group containing 8 to 18 carbon atoms, c is 0 to 3, and d is 1 to 20.

6. A cleaner according to claim 5, wherein the nonionic surfactant is a compound of formula (II) wherein G is a glucose unit.

7. A cleaner according to claim 5, comprising 0.05% to 10% by weight of an anionic surfactant.

8. A cleaner according to claim 7, wherein the weight ratio of anionic surfactant to cationic polymer is 20:1 to 1:20.

9. A cleaner according to claim 7, comprising 0.1% to 7% by weight of an anionic surfactant.

10. A cleaner according to claim 9, wherein the weight ratio of anionic surfactant to cationic polymer is 10:1 to 1:10.

11. A cleaner according to claim 5, comprising 0.05% to 10% by weight of a nonionic nitrogen-containing surfactant.

12. A cleaner according to claim 11, wherein the weight ratio of nonionic nitrogen-containing surfactant to cationic polymer is 40:1 to 1:10.

13. A cleaner according to claim 11, comprising 0.1% to 5% by weight of a nonionic nitrogen-containing surfactant.

14. A cleaner according to claim 13, wherein the nonionic nitrogen-containing surfactant is selected from the group consisting of nitrogen-containing fatty acid alkanolamides, fatty acid polyhydroxyamides, and fatty amine oxides.

15. A cleaner according to claim 13, wherein the weight ratio of nonionic nitrogen-containing surfactant to cationic polymer is 20:1 to 1:5.

16. A cleaner according to claim 8, comprising 0.05% to 10% by weight of a hydrogen-containing amphoteric surfactant.

17. A cleaner according to claim 16, comprising 0.1% to 5% by weight of the nitrogen-containing amphoteric surfactant.

18. A cleaner according to claim 17, wherein the the nitrogen-containing amphoteric surfactant is a betaine.

19. A cleaner according to claim 4, comprising 0.05% to 10% by weight of an anionic surfactant.

20. A cleaner according to claim 19, wherein the weight ratio of anionic surfactant to cationic polymer is 20:1 to 1:20.

21. A cleaner according to claim 19, comprising 0.1% to 7% by weight of an anionic surfactant.

22. A cleaner according to claim 21, wherein the weight ratio of anionic surfactant to cationic polymer is 10:1 to 1:10.

23. A cleaner according to claim 4, comprising 0.05% to 10% by weight of a nonionic nitrogen-containing surfactant.

24. A cleaner according to claim 23, wherein the weight ratio of nonionic nitrogen-containing surfactant to cationic polymer is 40:1 to 1:10.

25. A cleaner according to claim 23, comprising 0.1% to 5% by weight of a nonionic nitrogen-containing surfactant.

26. A cleaner according to claim 25, wherein the nonionic nitrogen-containing surfactant is selected from the group consisting of nitrogen-containing fatty acid alkanolamides, fatty acid polyhydroxyamides, and fatty amine oxides.

27. A cleaner according to claim 25, wherein the weight ratio of nonionic nitrogen-containing surfactant to cationic polymer is 20:1 to 1:5.

28. A cleaner according to claim 4, further comprising an abrasive alkali metal carbonate component.

29. A cleaner according to claim 28, wherein the abrasive component has an average particle size of about 200 $\mu$m±100 $\mu$m.

30. A cleaner according to claim 29, wherein the abrasive component is sodium bicarbonate.

31. A cleaner according to claim 4, comprising 0.05% to 10% by weight of a nitrogen-containing amphoteric surfactant.

32. A cleaner according to claim 31, comprising 0.1% to 5% by weight of the nitrogen-containing amphoteric surfactant.

33. A cleaner according to claim 32, wherein the the nitrogen-containing amphoteric surfactant is a betaine.

34. A hard surface cleaner comprising:

a) 0.01% to 10% by weight of a cationic polymer comprising at least 40 mole percent monomer units of the formula (I):

(I)

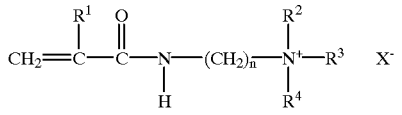

wherein n is 2 to 4, $R^1$ is hydrogen or methyl, and $R^2$, $R^3$ and $R^4$ independently are hydrogen, $C_{1-4}$ alkyl, or $C_{1-4}$ alkenyl, and $X^-$ is an anion selected from the group consisting of halide anions and monoalkyl anions of sulfuric acid semiester;

b) 0.1% to 50% by weight of a nonionic surfactant comprising:

1) an alkyl polyglycoside of the formula (II):

$$R^5O—[G]_p \quad \text{(II)}$$

wherein $R^5$ is an alkyl group containing 8 to 22 carbon atoms, G is a sugar unit containing 5 or 6 carbon atoms, and p is a number of 1 to 10; or 2) a fatty alcohol polypropylene glycol/polyethylene glycol ethers of the formula (III):

(III)

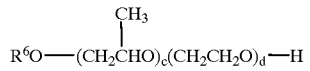

wherein $R^6$ is a linear or branched aliphatic alkyl or alkenyl group containing 8 to 18 carbon atoms, c is 0 to 3, and d is 1 to 20;

c) 0.05% to 10% by weight of an anionic surfactant; and d) 0.05% to 10% by weight of a nonionic nitrogen-containing surfactant.

35. A cleaner according to claim 34, further comprising an alkali metal carbonate abrasive component.

* * * * *

UNITED STATES PATENT AND TRADEMARK OFFICE

CERTIFICATE OF CORRECTION

PATENT NO. : 6,251,849 B1
APPLICATION NO. : 09/091041
DATED : June 26, 2001
INVENTOR(S) : Jeschke et al.

It is certified that error appears in the above-identified patent and that said Letters Patent is hereby corrected as shown below:

In column 11, line 17, delete “hydrogen-containing”, and insert therefor --nitrogen-containing--.

Signed and Sealed this

Thirty-first Day of July, 2007

JON W. DUDAS
*Director of the United States Patent and Trademark Office*